US008207681B2

(12) United States Patent
Breuer et al.

(10) Patent No.: US 8,207,681 B2
(45) Date of Patent: Jun. 26, 2012

(54) CIRCUIT ARRANGEMENT AND METHOD FOR REGULATING THE CURRENT THROUGH AT LEAST ONE DISCHARGE LAMP

(75) Inventors: Christian Breuer, Newburyport, MA (US); Markus Baier, Munich (DE); Martin Brueckel, Shenzhen (CN); Andreas Huber, Maisach (DE)

(73) Assignee: Osram AG, Munich (DE)

( * ) Notice: Subject to any disclaimer, the term of this patent is extended or adjusted under 35 U.S.C. 154(b) by 192 days.

(21) Appl. No.: 12/864,245

(22) PCT Filed: Jan. 24, 2008

(86) PCT No.: PCT/EP2008/050809

§ 371 (c)(1),
(2), (4) Date: Jul. 23, 2010

(87) PCT Pub. No.: WO2009/092447

PCT Pub. Date: Jul. 30, 2009

(65) Prior Publication Data

US 2010/0295467 A1 Nov. 25, 2010

(51) Int. Cl.
*H05B 41/36* (2006.01)

(52) U.S. Cl. ..... 315/291; 315/307

(58) Field of Classification Search ..... 315/291, 315/293, 297, 307, 308
See application file for complete search history.

(56) References Cited

U.S. PATENT DOCUMENTS

| | | | | |
|---|---|---|---|---|
| 5,828,187 | A | 10/1998 | Fischer | |
| 8,093,836 | B2 * | 1/2012 | Busse et al. | 315/307 |
| 2006/0186834 | A1 * | 8/2006 | Ribarich et al. | 315/312 |
| 2007/0090775 | A1 * | 4/2007 | Ribarich | 315/291 |
| 2008/0185980 | A1 * | 8/2008 | Van Casteren et al. | 315/308 |
| 2009/0302777 | A1 * | 12/2009 | Li et al. | 315/287 |
| 2010/0060200 | A1 * | 3/2010 | Newman et al. | 315/307 |

FOREIGN PATENT DOCUMENTS

| | | | |
|---|---|---|---|
| DE | 102006014062 | A1 | 10/2007 |
| EP | 0779768 | A2 | 6/1997 |

OTHER PUBLICATIONS

English abstract of DE 10 2006 014 062 A1.
International Search Report of PCT/EP2008/050809 dated Feb. 23, 2010.

* cited by examiner

*Primary Examiner* — Don Le

(57) ABSTRACT

A circuit arrangement for the closed-loop control of the current through at least one discharge lamp may include a control loop including: a setpoint value input for supplying a setpoint value; an actual value input for supplying an actual value; and an output for providing a signal, which has been correlated with the current through the at least one discharge lamp, the actual value having been correlated with the value of the current through the discharge lamp; and a setpoint value input apparatus, which is designed to provide the setpoint value to the control loop; wherein the setpoint value input apparatus includes: a microprocessor with at least one input, the microprocessor being designed to couple the at least one input to a potential from a group of at least two different potentials; and a wiring apparatus with at least one input, which is coupled to the at least one input of the microprocessor, and at least one output, which is coupled to at least one point of the control loop.

13 Claims, 1 Drawing Sheet

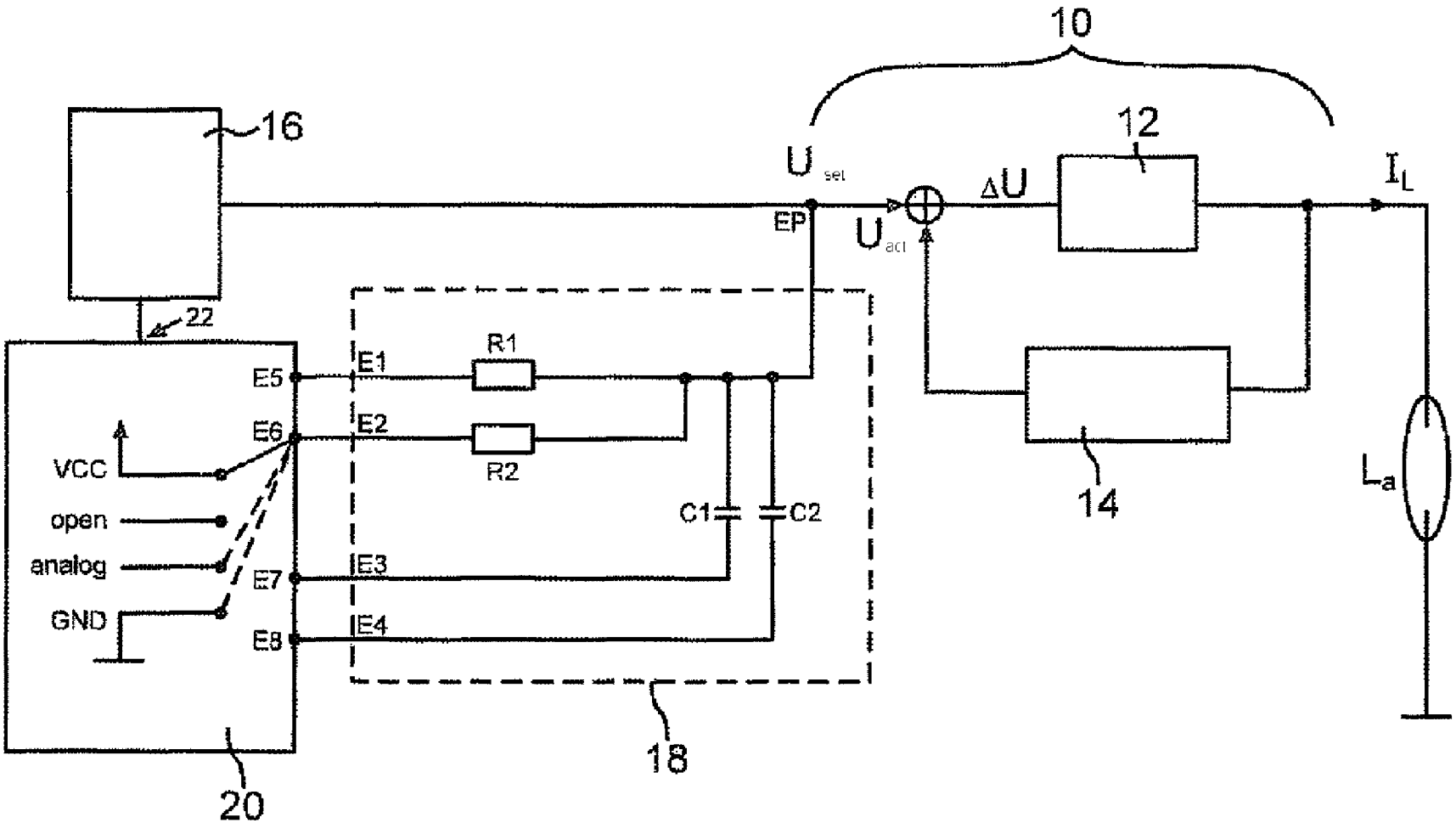
10
12
14
16
18
20
22
$I_L$
$L_a$
$\Delta U$
$U_{set}$
$U_{act}$
EP
C1
C2
R1
R2
E1
E2
E3
E4
E5
E6
E7
E8
VCC
open
analog
GND

CIRCUIT ARRANGEMENT AND METHOD FOR REGULATING THE CURRENT THROUGH AT LEAST ONE DISCHARGE LAMP

RELATED APPLICATIONS

The present application is a national stage entry according to 35 U.S.C. §371 of PCT application No.: PCT/EP2008/050809 filed on Jan. 24, 2008.

TECHNICAL FIELD

Various embodiments relate to a circuit arrangement for the closed-loop control of the current through at least one discharge lamp with a control loop, which includes a setpoint value input for supplying a setpoint value, an actual value input for supplying an actual value and an output for providing a signal, which has been correlated with the current through the at least one discharge lamp, the actual value having been correlated with the value of the current through the discharge lamp, and a setpoint value input apparatus, which is designed to provide the setpoint value to the control loop. Various embodiments moreover relate to a method for the closed-loop control of the current through at least one discharge lamp by means of such a circuit arrangement.

BACKGROUND

The present invention is concerned with the problem that a lamp current, on its path through an electronic ballast, cables and the lamp itself, flows through a resonant system with parasitic components with an inductive, capacitive and/or resistive nature. As a result, the form of the lamp current deviates from a predetermined setpoint value. A setpoint value is generally input by a DAC (digital-to-analog converter), by an RC element or by an R2R network. A DAC is firstly expensive and secondly its maximum operating frequency represents the maximum change frequency of the setpoint value. In the case of an RC element, different setpoint values can be generated by varying the duty cycle of a driving PWM signal. In this case, an RC element has a time constant $\tau$. If the RC element is dimensioned such that the time constant $\tau$ is low, the setpoint value can follow rapid changes in level, but the ripple on the signal will be greater. Conversely, if $\tau$ is selected to be high, the ripple on the lamp current will be lower, but it is now only possible for slower changes in level to be performed. In the case of an R2R network for inputting the setpoint value, an enormous amount of complexity is involved: for example, 24 components are even required for implementing an 8-bit R2R network.

SUMMARY

Various embodiments are subjecting the lamp current to closed-loop control as quickly and precisely as possible despite parasitic and limiting influences. By way of example, high change rates for the setpoint value should be achievable with as little ripple as possible.

Various embodiments are based on the knowledge that the above effect can be achieved if a dynamic change in the time constant of the control loop is enabled. Thus, a relatively slow time constant of the control loop can be implemented for slow changes in the setpoint value, whereas a rapid time constant for the control loop can be initiated for rapid changes in the setpoint value. Accordingly, in the case of a circuit arrangement according to various embodiments, the setpoint value input apparatus furthermore includes a microprocessor with at least one input, the microprocessor being designed to couple the at least one input to a potential from a group of at least two different potentials and a wiring apparatus with at least one input, which is coupled to the at least one input of the microprocessor, and at least one output, which is coupled to at least one point of the control loop.

Therefore, during the slow change rates of the setpoint value, ripple can be reliably minimized, while nevertheless rapid change rates of the setpoint value can be performed.

By virtue of the measure according to the invention, the lamp current can be subjected to extremely precise closed-loop control. This results in different advantages in projection applications: Firstly, the light emission can be monitored very precisely. This is required in projection methods with digital light modulation, for example DLP, in order to achieve setting of the image colors which is as precise as possible. Secondly, this measure can be used to optimize the lamp current in respect of the requirements for the lamp; for example, the timing of pulse and commutation influences the tip growth on the lamp electrodes and therefore the luminous efficacy of the projection system. Thirdly, switching overshoots can be avoided, as a result of which the acoustic noise of the ballast is reduced. Furthermore, inductances in the electronic ballast can be further controlled thereby without the risk of said inductances entering saturation. Finally, the lamp current can be optimized with respect to the requirements of the electronic ballast; for example artificially extended switching flanks can be produced by the measure according to the invention. As a result, the noise emission of components of the electronic ballast, in particular by inductances and capacitors, is reduced.

Preferably, the at least one point of the control loop to which the output of the wiring apparatus is coupled is the actual value input, the setpoint value input and/or the output of the control loop. There are therefore different possibilities available as to where intervention can be made in the control loop in order to change the time constant thereof. Depending on the application, one or the other variant may be preferred.

Preferably, the group of potentials of the microprocessor comprises at least two of the following potentials: ground, analog value, high resistance, tristate, with pullup resistor, without pullup resistor, with pulldown resistor, without pulldown resistor, open (floating) and supply voltage. Depending on which potentials are selected, different effects on the time constants which can be realized with one and the same wiring apparatus result. In particular, in the meantime only different ones of the mentioned potentials are available in different microprocessors, but all of the mentioned potentials can be used for implementing the inventive step.

Particularly preferably, the microprocessor is designed to switch the at least one input to and fro between two potentials, in particular ground and supply voltage, periodically with a predeterminable duty cycle. As a result, virtually a PWM signal is applied to the wiring apparatus, whose duty cycle and frequency can be used to vary, as desired, the setpoint value provided at the control loop.

Preferably, the control loop accordingly has a time constant for the closed-loop control, the wiring apparatus including at least one component for influencing this time constant. Preferably, for this reason, the wiring apparatus includes at least one nonreactive resistor and/or at least one capacitor. The wiring apparatus can therefore be implemented in a particularly inexpensive manner by means of passive components.

Particularly preferably, the wiring apparatus includes at least two components, which are coupled firstly to in each case one point, in particular the same point, of the control loop and secondly to in each case one input, in particular different inputs, of the microprocessor. Thus, the effect of the respective component can be switched on or off separately or varied in terms of its intensity.

Further preferably, the wiring apparatus has at least one first input and one second input, and the microprocessor has at least one first input and one second input, the first input of the wiring apparatus being coupled to the first input of the microprocessor and the second input of the wiring apparatus being coupled to the second input of the microprocessor, the first input and the second input of the microprocessor being coupled to the same potential or to different potentials. Thus, different components of the wiring apparatus can be coupled to different potentials in order to thus influence the time constant of the control loop.

In accordance with a preferred development, the microprocessor has an interface in order to couple the at least one input to a predeterminable potential from the group of at least two different potentials.

Further preferably, the setpoint value input apparatus includes a drive apparatus, the drive apparatus preferably being capable of being controlled by the microprocessor via the interface. This opens up the possibility of providing a digital-to-analog converter in the drive apparatus, said digital-to-analog converter then being coupled to the at least one point of the control loop. The signal provided via the wiring apparatus and the signal provided by the digital-to-analog converter can thus be superimposed on one another at the coupling-in point in order to generate the setpoint value. This results in yet further possibilities of changing the setpoint value as desired.

The preferred embodiments proposed with reference to the circuit arrangement according to the invention and the advantages thereof apply, where appropriate, correspondingly to the method according to the invention.

BRIEF DESCRIPTION OF THE DRAWING(S)

The following detailed description refers to the accompanying drawings that show, by way of illustration, specific details and embodiments in which the invention may be practiced.

An exemplary embodiment of a circuit arrangement according to the invention will now be described in more detail below with reference to the attached drawing, which shows a schematic illustration of an exemplary embodiment of a circuit arrangement according to the invention.

DETAILED DESCRIPTION

FIG. 1 shows a schematic illustration of an exemplary embodiment of a circuit arrangement according to the invention. Said circuit arrangement provides a lamp current $I_L$ to a discharge lamp La at the output of said circuit arrangement. Said circuit arrangement includes a control loop 10, whose reference variable represents a setpoint value $U_{set}$ and whose feedback variable represents an actual value $U_{act}$, the controlled deviation $\Delta U$ being formed by subtraction from these variables. The control deviation $\Delta U$ is supplied to a load circuit 12 of the circuit arrangement, as a result of which the lamp current $I_L$ is produced as an output variable of the control loop 10. The actual value $U_{act}$ is generated from the lamp current $I_L$ via a discriminating element 14, for example, a shunt resistor, which is arranged at a suitable point in the load circuit.

The circuit arrangement shown in FIG. 1 furthermore includes a drive apparatus 16, which provides a first proportion of the reference variable $U_{set}$ at a coupling-in point EP at the output of said drive apparatus and, for this purpose, preferably comprises a digital-to-analog converter. A second proportion of the reference variable $U_{set}$ is provided by a wiring apparatus 18, which is likewise coupled to the coupling-in point EP and has a plurality of inputs E1 to E4, which are coupled to corresponding inputs E5 to E8 of a microprocessor 20. The microprocessor 20 is designed to couple each of its inputs E5 to E8 to one of the potentials VCC, Open, Analog, GND, as is illustrated by way of example for its input E6. The coupling can also be designed such that the microprocessor switches to and fro periodically between two or more potentials, as a result of which virtually a PWM signal is applied to the wiring apparatus 18. The setpoint value $U_{set}$ provided at the control loop, in particular the time constant thereof, is fixed by the duty cycle and the frequency of the PWM signal.

The wiring apparatus 18 includes a nonreactive resistor R1, which is coupled between the input E1 of the wiring apparatus and the coupling-in point EP in the control loop 10. It furthermore includes a nonreactive resistor R2, which is coupled between the input E2 and the coupling-in point EP. Furthermore, a first capacitor C1 is provided, which is coupled between the input E3 and the coupling-in point EP, and a capacitor C2, which is coupled between the input E4 and the coupling-in point EP. The microprocessor 20 furthermore includes an interface 22, via which it controls the digital-to-analog converter of the drive apparatus 16.

By correspondingly selecting the potential to which the corresponding input is coupled, it is possible to achieve a situation in which the corresponding nonreactive resistor R1, R2 and/or the corresponding capacitor C1, C2 is switched on or off, as a result of which the time constant of the setpoint value input is influenced.

A change in the capacitance which is effective at the coupling-in point EP is preferably performed for a permanent change in the time constant. For a temporary change in the time constant, the nonreactive resistance which is effective at the coupling-in point EP is preferably changed. If, for example, the input E5 is connected to VCC, the level at the coupling-in point EP can thus be increased rapidly. If the input E5 is connected to ground GND, the level at the coupling-in point of the controller can thus be reduced rapidly.

In accordance with an embodiment (not illustrated), the coupling-in point can alternatively or additionally be the actual value input and/or the output of the control loop 10. Likewise, further potentials can be provided instead of the potentials illustrated in the microprocessor 20, for example high resistance, tristate, with pullup resistor, without pullup resistor, with pulldown resistor, without pulldown resistor.

In a preferred embodiment, the drive apparatus 16 is dispensed with. In this case, at the coupling-in point EP, only one proportion provided by the microprocessor 20 via the wiring apparatus 18 is provided as setpoint value $U_{set}$ at the coupling-in point EP.

In general, the time sequence of the setpoint value is stored in the microprocessor 20 or else can be supplied to the microprocessor 20 from the outside via an interface (not illustrated).

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit arrangement for the closed-loop control of the current through at least one discharge lamp, the circuit arrangement comprising:

a control loop comprising:

a setpoint value input configured to supply a setpoint value;

an actual value input configured to supply an actual value; and an output configured to provide a signal, which has been correlated with the current through the at least one discharge lamp, the actual value having been correlated with the value of the current through the discharge lamp; and a setpoint value input apparatus, which is designed to provide the setpoint value to the control loop;

wherein the setpoint value input apparatus comprises:

a microprocessor with at least one input, the microprocessor being designed to couple the at least one input to a potential from a group of at least two different potentials; and a wiring apparatus with at least one input, which is coupled to the at least one input of the microprocessor, and at least one output, which is coupled to at least one point of the control loop.

2. The circuit arrangement as claimed in claim 1, wherein the at least one point of the control loop to which the output of the wiring apparatus is coupled is the actual value input, at least one of the setpoint value input and the output of the control loop.

3. The circuit arrangement as claimed in claim 1, wherein the group of potentials of the microprocessor comprises at least two of the following potentials:

Ground;

analog value;

high resistance;

tristate;

with pullup resistor;

without pullup resistor;

with pulldown resistor;

without pulldown resistor;

open; and supply voltage.

4. The circuit arrangement as claimed in claim 3, wherein the microprocessor is designed to switch the at least one input to and fro between two potentials periodically with a predeterminable duty cycle.

5. The circuit arrangement as claimed in claim 1, wherein the control loop has a time constant for the closed-loop control, the wiring apparatus comprising at least one component for influencing this time constant.

6. The circuit arrangement as claimed in claim 5, wherein the wiring apparatus comprises at least one of at least one nonreactive resistor and at least one capacitor.

7. The circuit arrangement as claimed in claim 5, wherein the wiring apparatus comprises at least two components, which are coupled firstly to in each case one point, of the control loop and secondly to in each case one input of the microprocessor.

8. The circuit arrangement as claimed in claim 7, wherein the wiring apparatus has at least one first input and one second input, and the microprocessor has at least one first input and one second input, the first input of the wiring apparatus being coupled to the first input of the microprocessor and the second input of the wiring apparatus being coupled to the second input of the microprocessor, the first input and the second input of the microprocessor being coupled to the same potential or to different potentials.

9. The circuit arrangement as claimed in claim 1, wherein the microprocessor has an interface in order to couple the at least one input to a predeterminable potential from the group of at least two different potentials.

10. The circuit arrangement as claimed in claim 1, wherein the setpoint value input apparatus comprises a drive apparatus.

11. The circuit arrangement as claimed in claim 10, wherein the drive apparatus is configured to be controlled by the microprocessor via the interface.

12. The circuit arrangement as claimed in claim 10, wherein the drive apparatus comprises a digital-to-analog converter, which is coupled to the at least one point of the control loop.

13. A method for the closed-loop control of the current through at least one discharge lamp by means of a circuit arrangement with a control loop, which has a setpoint value input for supplying a setpoint value, an actual value input for supplying an actual value and an output for providing a signal, which has been correlated with the current through the at least one discharge lamp, the actual value having been correlated with the value of the current through the discharge lamp, and a setpoint value input apparatus, which is designed to provide the setpoint value to the control loop;

the method comprising:

providing a microprocessor with at least one input;

providing a wiring apparatus with at least one input; and with at least one output;

coupling the at least one input of the wiring apparatus to at least one input of the microprocessor and coupling the at least one output of the wiring apparatus to at least one point of the control loop; and coupling the at least one input of the microprocessor to a potential from a group consisting of at least two different potentials.

* * * * *